United States Patent [19]

Serrano

[11] 4,165,196

[45] Aug. 21, 1979

[54] METHOD OF CONSTRUCTING A COLUMN FORMED FROM ANNULAR ELEMENTS AND ELEMENTS FOR THE APPLICATION OF SAID METHOD

[75] Inventor: Francisco de Assis M. Serrano, Issy-les-Moulineaux, France

[73] Assignee: Compagnie Generale pour les Developpements Operationnels des Richesses Sous Marines "C.G. Doris", Paris, France

[21] Appl. No.: 896,610

[22] Filed: Apr. 14, 1978

[30] Foreign Application Priority Data

Apr. 14, 1977 [FR] France ..... 77 11233

[51] Int. Cl.[2] ..... E02D 21/00

[52] U.S. Cl. ..... 405/205; 405/209; 405/170

[58] Field of Search ..... 61/96, 50, 43, 56.5, 61/86, 101, 97, 110, 111; 405/205, 204

[56] References Cited

U.S. PATENT DOCUMENTS

| | | | |
|---|---|---|---|
| 2,877,628 | 3/1959 | Maunsell | 61/43 |
| 3,859,806 | 1/1975 | Guy et al. | 61/96 |
| 3,901,038 | 8/1975 | Olsen | 61/43 |

*Primary Examiner*—Jacob Shapiro

*Attorney, Agent, or Firm*—Armstrong, Nikaido, Marmelstein & Kubovcik

[57] ABSTRACT

A method of constructing a hollow column for resting on a base on a submarine bed, comprises the steps of simultaneously starting the construction of a number of elements that are to form the column, causing the partly constructed elements to float, finishing the construction of the elements afloat, bringing the elements into the horizontal position and connecting them together to form the column, said elements being provided with impervious closures at each end thereof and an impervious caisson adjacent each end thereof, and those of the closures and caissons not required when the column is placed in position are dismantled.

10 Claims, 7 Drawing Figures

Figure 1A:
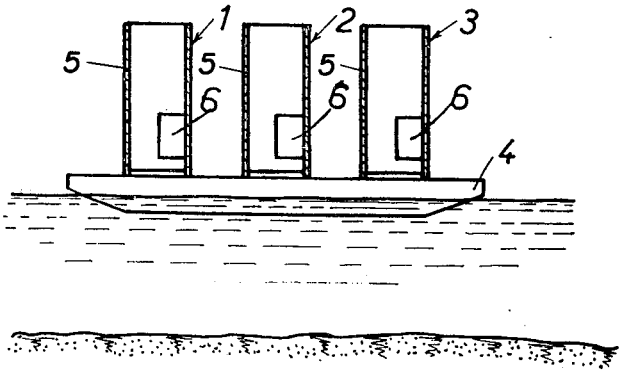

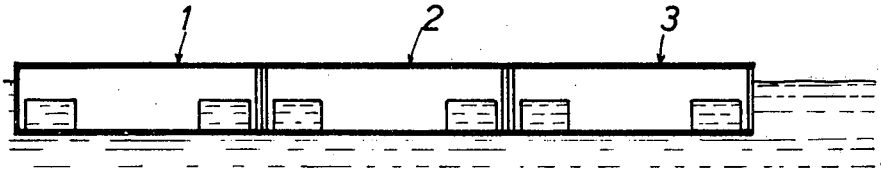
FIG.: 1e
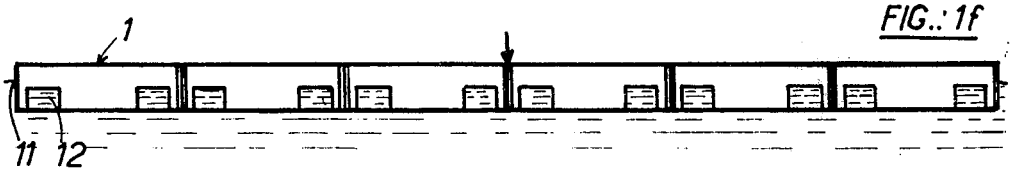
FIG.: 1f
FIG.: 2
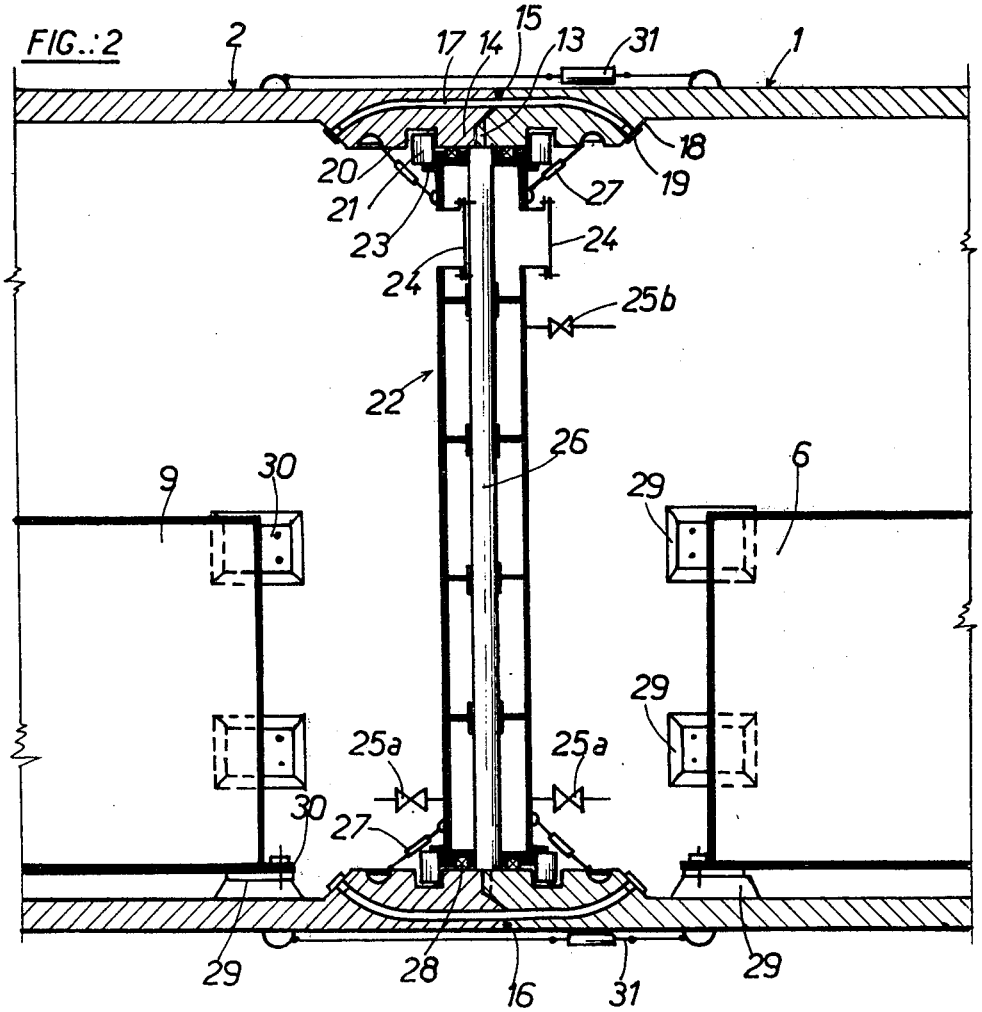

METHOD OF CONSTRUCTING A COLUMN FORMED FROM ANNULAR ELEMENTS AND ELEMENTS FOR THE APPLICATION OF SAID METHOD

This invention relates to a method of constructing a column formed of annular elements, said column being intended more particularly to rest on a base bearing on the submarine bed and to support a deck carrying production or research installations.

U.S. Pat. No. 3624702 discloses a column formed of annular segments comprising longitudinal channels in which prestressed cables are located. The segments are prefabricated either on land or on a barge. They are then placed end to end in barges, in such manner that prestressed cables can be passed right along the column. The assembled column is lowered by means of a crane into a vertical position on its site.

This method of forming a column is particularly suitable for columns for average depths of less than 100 meters.

The method of constructing elements about 6 meters in length and about 6 meters in diameter and their launching along barges does not present any difficulties.

It is quite otherwise in the case of columns for reaching much greater depths (of 100 to 300 meters), the assembly of the segments on barges and then the righting of the column by crane then presenting such difficulties that the method cannot be used.

In order for the method to be simple and economic, the masses to be assembled and manipulated should have weights of 1000 to 4000 tons.

The invention envisages a method of constructing a column from annular elements which can be several dozen meters in length and capable of being assembled in a simple manner to form columns for great depths.

It is also an object of this method to reduce the construction time and the necessity for substantial lifting equipment.

A method of constructing a column formed from annular elements, the said column being intended more particularly to rest on a base bearing on the submarine bed and to support a deck carrying production or research installations, is characterised by the following sequence of operations:

simultaneous construction on land or on barges of at least one section of each of the elements for forming the column, impervious closure at least partially of the lower end of the sections, positioning a first impervious caisson on or near the base, floating the sections of the elements, completing the simultaneous construction by the sliding casing method, positioning a second impervious caisson at the upper end of the elements, imperviously closing at least temporarily the upper end of the completed elements, swinging the elements into the horizontal by ballasting the caissons with water, assembling and fixing the elements in one or more groups, then final assembly, dismantling the caissons and partitions not used in the final stage of placing the column into position.

The invention also comprises an element for use in carrying out said method and being provided at its lower and upper ends with devices for temporarily fixing an impervious partition and an impervious caisson.

The caisson is fabricated independently of the element.

When the caisson is ultimately to be used for ensuring the stability of the column, it may be constructed in situ.

The caisson constitutes a semi-cylindrical space.

The description and drawings, given hereinafter by way of example, will enable the method of carrying the invention into effect to be understood.

FIGS. 1*a* to 1*f* show the different stages in the construction of a column according to the invention.

FIG. 2 is a sectional view of a joint between two elements.

It is convenient to construct columns for sites of great depth (of 100 to 300 meters) near to a shore with a small depth of water (of the order of 30 meters for example). These columns will be constructed of elements, the construction of each element being started on land or on a barge, as shown in FIG. 1*a*. In order to reduce construction time, it is advantageous to construct the elements for forming the column simultaneously, for example three elements 1, 2, 3. The construction of these elements on a barge is continued up to heights of 10 to 20 meters for example. The lower end receives an impervious closure 5 and an impervious caisson 6 is then placed in position, said caisson having, for example, a semicylindrical shape. The cylindrical wall has clamps along its edges which are secured to countersunk bolts provided for this purpose on the inside wall of the element. The method of fixing will be described with reference to FIG. 2. The type of caisson previously described is prefabricated of concrete or metal but the caissons could also be produced in situ and particularly in the case of the element located at the base or top of the column. The caisson of the base element is used in the ballasting of the column when placing it in position and the caisson of the upper element enables the righting of the column to be regulated when it is placed on the base.

Figure 1B:
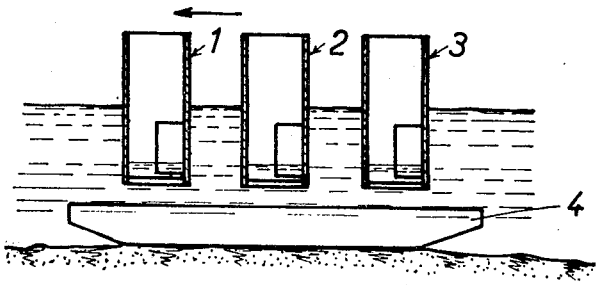
Figure 1C:
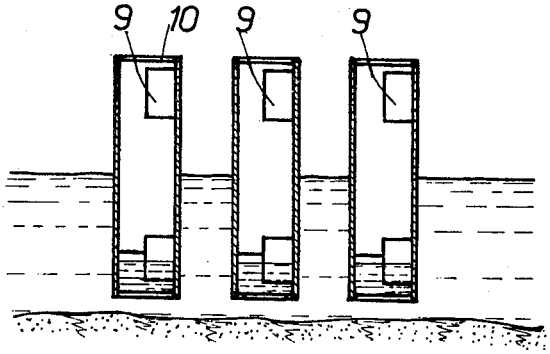
Figure 1D:
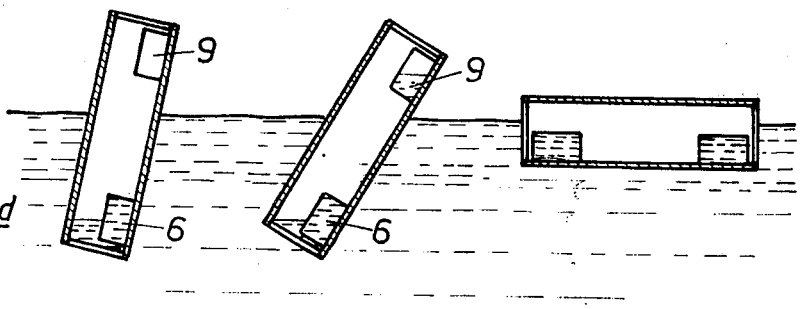

When the height of the sections of the elements is such that it is no longer possible for stability reasons to keep them on barges, the construction or transport barges 4 are sunk and the sections floated (FIG. 1*b*). In order to maintain stability and also to reduce the emergent height, water is introduced into the lower part of the sections and into the caissons, and the construction of the elements is continued simultaneously by the well-known sliding casing method. The weight of the element section as well as the ballasting water progressively sink the sections and thus allow the upper part of said sections to be kept in a position allowing easy access at the working level.

When the elements have reached the desired height (of the order of 50 meters for dock depths of the order of 30 meters) the upper part (FIG. 1*c*) receives a second impervious caisson 9 located on the same side as the lower caisson 6. In order to maintain the perpendicularity of the element, the weight of the caissons is balanced by differentially filling the bottom of the element and the lower caisson 6. An impervious partition closes the upper part of the element.

The elements are then swung into the horizontal (FIG. 1*d*) by progressively filling the lower caisson 6 and transferring the water occupying the lower part of the section into the upper caisson 9. The elements 1, 2, 3 (FIG. 1*e*) are brought into alignment and are assembled either in groups of two or three, or one after the other when their number is not too large. The groups are then assembled to form the column. The assembling of the elements one to the other may be effected, according to a method similar to that described in British Pat. No. 1481960, by the passage of prestressed cables through ducts formed when constructing the element.

When the elements constituting the column have been assembled, the intermediate impervious partitions and a certain number of the impervious caissons not used for the righting of the column into the vertical position and its immersion on site, are dismantled.

The column, of which the base element may comprise a wall 11 and a caisson 12 formed during its construction, is ballasted so as to right it and lead to the emergence into the vertical position of the upper end of the element 1.

FIG. 2 shows in section the carrying out of the assembly according to one embodiment of an element for carrying out the method of construction according to the invention, the lower edge of the element 1, for example, is formed in the interior with an annular conical centering lug constituting a male locking device, which is engaged in an annular housing 14 of corresponding form or female locking device formed in the upper edge of the element 2. A notch 15 is provided near to the external surface of the element 1 in which is engaged an inflatable packing 16.

According to the embodiment shown, the ends of the elements have a part of smaller interior diameter to that of the wall, forming a thickened portion. In this thickened portion, there are provided during the construction passages 17 for prestressed cables opening on the oblique parts 18. The relative positions of the passages are such that the passages on an end of one element correspond to those on the other end of another element. The passages open on the interior surface of the element. The angular disposition of one element with reference to the other is effected in a manner well known to the experts.

The thickened portion is formed with a circular groove 20 in which is lodged a circular block 21 formed of several pieces and which retains the impervious partition 22 forming a part of a temporary fixing device. The partition consists of a circular panel formed on its periphery with a centering profile 23. An impervious door 24 is provided near to one of its edges. Valves 25 located approximately on a diameter enable the interior of the element to be put into communication with the space 26 between two adjacent partitions. Turnbuckles 27, forming part of the fixing device, keep the partition clamped against the blocks 21 in the absence of water pressure during the tilting operations, for example. The periphery of the partitions forms a spherical crown having at its centre an inflatable joint 28 ensuring imperviousness. The impervious caissons 6 and 9 occupy approximately half of the interior space and are fixed to supports 29, formed during construction, by clamps 30 welded or sealed to the periphery of the cylindrical surface. When floating the sections (FIG. 1*b*), the openings of the passages 17 are temporarily closed by expansion plugs 19. After interlocking the elements, they are kept coupled by means of ties 31 located at the periphery. The joint 16 is then inflated and the water held in the space 26 emptied. The lower valve 25*a* is connected to a pump while the upper valve 25*b* is opened to allow the pressures to be counterbalanced. The impervious doors 24 are opened to allow passage into the other element. The expansion plugs are dismantled and prestressed cables are passed through the passages 17 and put under tension. Concrete is injected into the conical annular junction formed by the parts 13 and 14. The caissons are then dismantled, for example 6, the turnbuckles 27 are then freed and the blocks 21 withdrawn. The impervious partition is extracted by known means.

According to the embodiment illustrated in FIG. 1*a*, the base element, for example 1, has at its lower part a wall and a fixed caisson formed during the construction and which receive permanent ballasting either of concrete or sea water, or both, when placing in position on site.

I claim:

1. A method of constructing a hollow column from a plurality of annular elements, said column being intended more particularly to rest on a base bearing on a submarine bed and to support a deck carrying production or research installations, comprising the following sequence of operations:

(a) simultaneously constructing at least one section of each of a number of annular elements from which the column is to be formed, (b) forming an impervious closure at one end of each of said sections, (c) placing a first impervious caisson inside each of said sections adjacent said one end thereof, (d) causing said sections to float in water, (e) simultaneously finishing the construction of said elements, (f) placing a second impervious caisson inside each of said elements adjacent the other end thereof, (g) forming an impervious closure at the other end of each of said elements, (h) bringing the elements into the horizontal position by ballasting the caissons with water, (i) assembling the elements and fixing them together to form the column, and (j) dismantling those of the caissons and closures that are not required to be used when placing the column into position on a submarine bed.

2. A method according to claim 1, wherein operation (j) is preceded by the step of partially righting said column.

3. A method according to claim 1, wherein operation (e) is carried out by the sliding casing method.

4. A method according to claim 1, wherein operation (a) is carried out on a barge and operation (d) is carried out by sinking said barge.

5. A method according to claim 1, wherein operation (i) is carried out by connecting groups of said elements together to form parts of said column and then connecting said parts together to form the column.

6. Means for use in constructing a hollow column, comprising an annular element, a male interlocking device at one end of said element, a female interlocking device at the other end of said element, passages being formed in the annular wall of said element at each end thereof and leading from the end face of said wall to the interior face thereof, an impervious partition at each end of said element, means for temporarily fixing said partitions, a first impervious caisson inside said element adjacent one end thereof, and a second impervious caisson inside said element adjacent the other end thereof.

7. Means according to claim 6, in which the annular wall of said annular element is formed with thickened portions at each end thereof, said passages being formed in said thickened portions.

8. Means according to claim 6, wherein each of said impervious partitions is formed at its periphery with a centering profile for cooperating with said fixing means.

9. Means according to claim 6, wherein said fixing means comprise turnbuckles connected between said partitions and the internal face of said element.

10. Means according to claim 6, wherein the openings of said passages in the end faces of said annular wall are coincident.

* * * * *